US006472964B2

(12) United States Patent
Chaudot et al.

(10) Patent No.: US 6,472,964 B2
(45) Date of Patent: Oct. 29, 2002

(54) MAGNETIC TRIP

(75) Inventors: François Chaudot, Chatou; Frédéric Dorshner, Paris; Dominique Millot, Nanterre; Daniel Riffaud, Colombes, all of (FR)

(73) Assignee: Schneider Electric Industries SA, Rueil-Malmaison (FR)

( * ) Notice: Subject to any disclaimer, the term of this patent is extended or adjusted under 35 U.S.C. 154(b) by 2 days.

(21) Appl. No.: 09/739,784

(22) Filed: Dec. 20, 2000

(65) Prior Publication Data

US 2002/0050879 A1 May 2, 2002

(30) Foreign Application Priority Data

Dec. 20, 1999 (FR) ..... 99 16310

(51) Int. Cl.[7] ..... H01H 71/46; H01F 7/08

(52) U.S. Cl. ..... 335/172; 335/174; 335/179; 335/236; 335/229

(58) Field of Search ..... 335/21–45, 172–176, 335/236, 229

(56) References Cited

U.S. PATENT DOCUMENTS 4,442,418 A * 4/1984 Myers ..... 335/230

FOREIGN PATENT DOCUMENTS

| | | |
|---|---|---|
| DE | 10 51 370 | 2/1959 |
| DE | 198 20 768 | 11/1999 |
| WO | WO 82/03943 | 11/1982 |

* cited by examiner

*Primary Examiner*—Ramon M. Barrera
(74) *Attorney, Agent, or Firm*—Oblon, Spivak, McClelland, Maier & Neustadt, P.C.

(57) ABSTRACT

A magnetic trip with a fixed magnetic circuit polarised by a permanent magnet. The magnetic circuit includes two preferably identical parallel wafers each defining a main branch and a deflection tab with the presence of a coil on each branch. At their ends opposite to the mobile pallet, the wafers have in cross-section an L shape. The insulation structure carrying the coils is formed of two half-shells tightly holding the wafers. The trip can be used in circuit breakers.

8 Claims, 2 Drawing Sheets

MAGNETIC TRIP

BACKGROUND OF THE INVENTION

The present invention relates to a magnetic trip for an electrical switching device, comprising a fixed magnetic circuit which is in association with a permanent magnet, at least one coil able to be passed through by an electric current and in association with a circuit branch to determine a magnetic flow which is function of the current, and a moveable pallet acted upon by a spring and determining with the fixed magnetic circuit a main flow loop.

It is important to be able to manufacture such a magnetic trip so that its pallet activates the trip mechanism of the device as rapidly as possible, for example in a few tenths of a millisecond, in response to excess current in the coil. It is moreover desirable for the magnetic flow induced by the excess current not to lead to demagnetisation of the permanent magnet.

BRIEF SUMMARY OF THE INVENTION

The purpose of the invention is to make highly reactive a trip of the type described and to simplify its manufacture.

According to the invention, the magnetic circuit includes, near the magnet, at least one magnetic flow deflection tab defining a secondary flow loop equipped with at least one secondary air gap, and the tab is arranged relative to the fixed magnetic circuit and to the magnet so that an excess current in the coil deflects the flow of the magnet to the secondary loop.

Preferably, the magnetic circuit includes two identical parallel wafers each having on the one hand a main branch carrying a coil and on the other hand a deflection tab, the free ends of the tabs defining two secondary transverse air gaps, and the magnet is placed between the wafers near the tabs.

Each coil may be wound onto a U-shaped insulation half-shell enclosing by the wings of the U the small sides of the corresponding wafer, with the result that the coil is immediately adjacent to a lateral face of the wafer, the half-shells being assembled so as to form an insulation structure carrying the coils and containing the wafers.

BRIEF DESCRIPTION OF THE DRAWINGS

The description will be given below of a non-restrictive embodiment of the invention, with reference to the appended drawings.

DETAILED DESCRIPTION OF THE INVENTION

Figure 1:
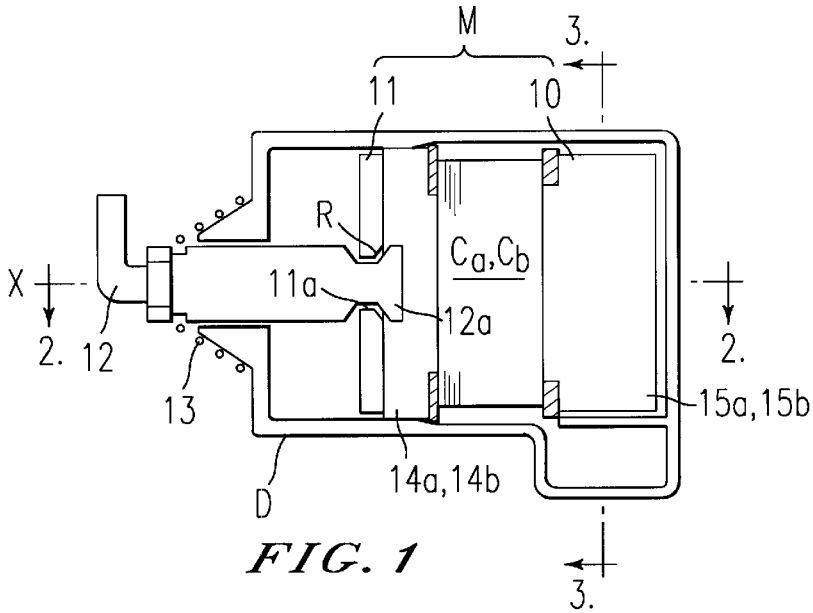
FIG. 1 is a cross-section elevation of a trip according to the invention.

The magnetic trip shown in FIG. 1 is intended to be mounted in a circuit-breaker, contactor-circuit-breaker or analogous switching device with a protection function and it includes a magnetic circuit M fitted with a fixed part 10, called hereinafter a fixed magnetic circuit, and with a mobile part 11, called hereinafter a mobile pallet; a permanent magnet A is in association with the fixed magnetic circuit 10 so as to impart to it a permanent magnetic flow. The fixed magnetic circuit 10 includes two wafers 10*a*, 10*b* parallel to each other, of a generally flat shape with median planes Pa, Pb extending along a direction X. The wafers are preferably identical. On the wafers 10*a*, 10*b* of the fixed magnetic circuit are placed two respective coils Ca, Cb. These coils are mounted electrically in series in a control circuit of the trip in order to provide, in the event of excess current in this circuit, the ampere turns necessary for the pallet 11 to be displaced.

The pallet 11 is moveable in translation in the direction X and it is coupled at one end 12*a* with an activation component such as a push-button 12. The push-button is able to activate a trip mechanism of the circuit-breaker. The connection R between the end 12*a* of the push-button 12 and a central associated channel 11*a* of the pallet 11 is slightly swivelling, as shown in FIG. 1, so as to optimise the air gap between the pallet and the fixed circuit. The push-button is acted upon by a spring 13, for example a compression spring, tending to separate the pallet from the polar ends 14*a*, 14*b* of the branches of the fixed magnetic circuit. The pallet is applied to the fixed magnetic circuit by the permanent magnet A against the effort of the spring.

The appearance of excess current in the coils causes the separation of the pallet 11 relative to the fixed magnetic circuit 10 and the displacement of the push-button 12 thanks to the effort of the spring 13.

Each wafer 10*a*, 10*b* has on its small sides, between its polar ends 14*a*, 14*b* and its ends 15*a*, 15*b* opposite to the ends 14*a*, 14*b*, a recessed part 16*a*, 16*b* which receives the coils Ca, Cb so as to reduce the space requirement of the trip. The ends 15*a*, 15*b* of the wafers 10*a*, 10*b* are intended to hold the permanent magnet A tight and to determine a deflection path T2 of the magnetic flow. The ends 15*a*, 15*b* of the wafers are configured in a specific way and include, so as to form two air gaps, on the one side a respective tab 17*a*, 17*b* and on the other side an edge 18*a*, 18*b* delimiting the contracted part 16*a*, 16*b*. The free end of each tab 17*a*, 17*b* integral with a wafer defines with the opposite edge 18*b*, 18*a* of the other wafer a predetermined transverse air gap 20*a*, 20*b*. "Transverse air gap" means that the air gap extends in a plane perpendicular to the direction X.

Figure 3:
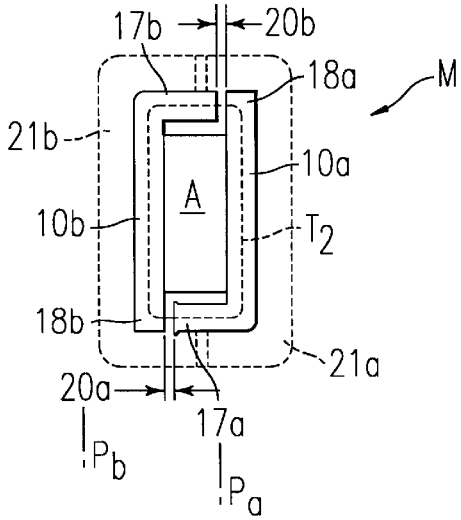
FIG. 3 is a cross-section along the plane 3—3.
Figure 4:
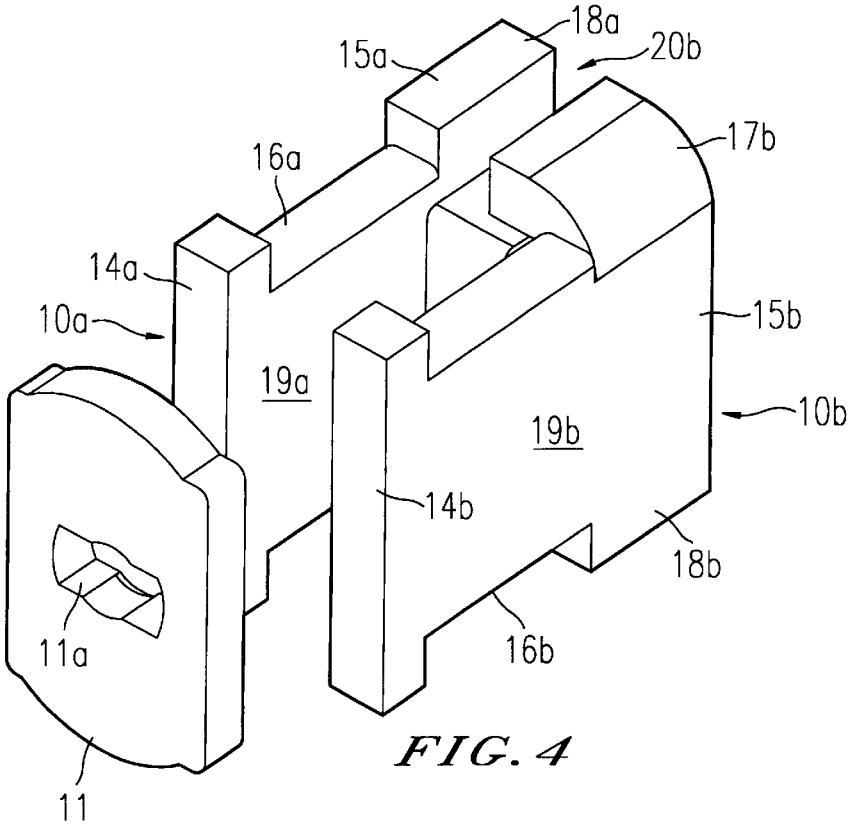
FIG. 4 shows in perspective and in large scale the magnetic circuit of the trip.
Figure 5:
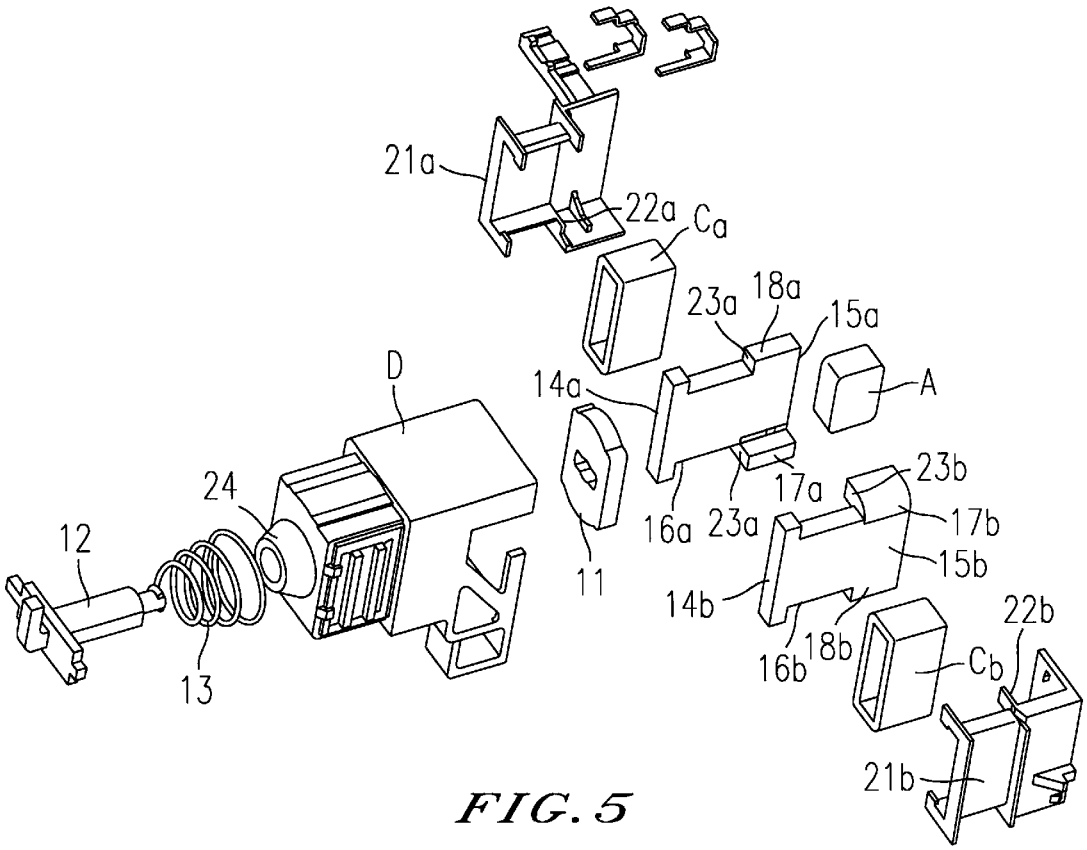
FIG. 5 is an exploded perspective view of the trip.

The tabs 17*a*, 17*b* constitute flow deflection branches of the magnetic circuit extending or continuing transversally (i.e. perpendicularly to the planes Pa, Pb and to the direction X) the main branches 19*a*, 19*b* formed by the wafers 10*a*, 10*b*, so as to channel in excess current state the magnetic flow induced. The wafers thus present an L-shape—or with a small wing and a large wing—the large wing of which is constituted by the main branch and the small wing of which is constituted by the tab or secondary branch. The permanent magnet A is inserted between the wafers 10*a*, 10*b* at the level of the transverse tabs 17*a*, 17*b* and of the edges 18*a*, 18*b* so as to brace the wafers arranged rather head to tail (see FIG. 3); it may be seen in this figure that, in transverse cross-section, the wafers present at their ends 15*a*, 15*b* an L shape to embrace the magnet A by generating the two air gaps 20*a*, 20*b*. It is advantageous to have identical wafers, which simplifies the manufacture of the trip.

Figure 2:
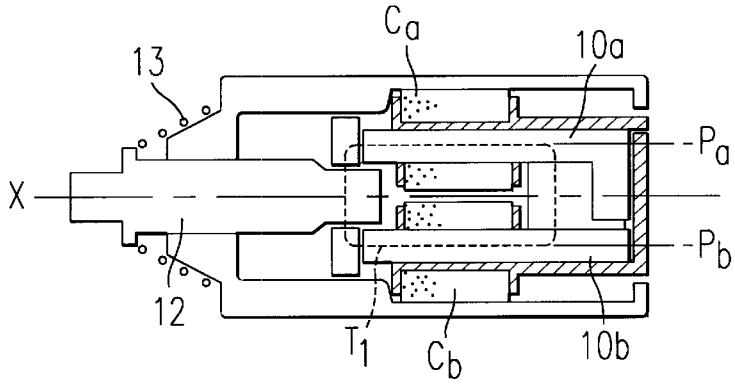
FIG. 2 is a view of it from above in cross-section along the plane 2—2.

The coils Ca, Cb are wound half over an insulation half-shell 21*a*, 21*b* and half over the respective wafer 10*a*, 10*b*, so as thus to be in direct contact with the latter on its internal face (see FIG. 2). The half-shells are U-shaped enclosing the wafers 10*a*, lob and present stops, 22*a*, 22*b* for shoulders 23*a*, 23*b* provided at any suitable place on the wafers. The assembled half-shells constitute an assembly shell or casing of the coils, this casing being housed in an insulation body D of the trip. The body D is fitted with an opening 24 for the push-button 12 and constitutes a support for the spring 13.

The trip described operates in the following way. In the absence of excess current in the coils Ca, Cb, the pallet 11 is applied to the polar surfaces of the ends 14*a*, 14*b* of the magnetic wafers 10*a*, 10*b* by the permanent magnet A against the effort of the spring 13. The flow developed by A circulates in a main loop T1 formed by the main branches 19*a*, 19*b* of the wafers of the pallet 11. In the event of excess current, the coils develop a magnetic flow which is opposed to the flow of the permanent magnet and which deflects it to the secondary branches constituted by the tabs 17*a*, 17*b*; the flow created by the permanent magnet then passes in a deflection loop T2 including the tabs 17*a*, 17*b* of the wafers, the air gaps 20*a*, 20*b* and the edges 18*a*, 18*b* of the wafers. There is therefore no demagnetisation of the permanent magnet and the spring 13 provides an effort greater than that coming from the residual magnetisation at the ends 14*a*, 14*b* of the metal wafers 10*a* and 10*b*, which very rapidly activates the push-button 12. The particularly compact configuration of the fixed magnetic circuit with its polarisation magnet makes it possible to reduce the dimensions of the pallet and to make it lighter, which makes the trip more reactive. The symmetrical architecture of the trip makes it particularly straightforward to manufacture and to assemble.

What is claimed is:

1. A magnetic trip for an electrical switching device, comprising:

a fixed magnetic circuit in association with a permanent magnet;

at least one coil configured to be passed through by an electric current and in association with a circuit branch so as to determine a magnetic flow current function; and a moveable pallet acted upon by a spring and determining, with the fixed magnetic circuit, a main flow loop, wherein the magnetic circuit includes, near the permanent magnet, at least one magnetic flow deflection tab defining a secondary flow loop and equipped with at least one first fixed secondary transverse air gap, and at least one magnetic flow deflection tab is configured relative to the fixed magnetic circuit and to the permanent magnet so that an excess current in the at least one coil deflects the flow of the permanent magnet to the secondary flow loop.

2. A trip according to claim 1, wherein the magnetic circuit includes two parallel wafers each having a main branch and the at least one magnetic flow deflection tab, free ends of the at least one magnetic flow deflection tab defining the first fixed secondary transverse air gap and a second fixed secondary transverse air gap, and the permanent magnet placed between the two parallel wafers near the at least one magnetic flow deflection tab.

3. A trip according to claim 2, wherein each of the two parallel wafers is associated with a coil.

4. A trip according to claim 3, wherein each coil is wound onto an insulation half-shell of U-shaped cross-section that encloses small sides of each of the two parallel wafers such that each coil is immediately adjacent to one lateral face of each of the two parallel wafers, and insulation half-shells are assembled to form an insulation structure carrying coils and containing the two parallel wafers.

5. A trip according to claim 4, wherein the insulation structure defines application stops of the branches of the magnetic circuit, the application stops forming a common reference plane for the moveable pallet.

6. A trip according to claim 2, wherein each of the two parallel wafers of the magnetic circuit are identical and the at least one magnetic flow deflection tab of one of the two parallel wafers is oriented transversally to the main branch and separated from another one of the two parallel wafers by one of the first and the second fixed secondary transverse air gaps.

7. A trip according to claim 2, wherein each of the two parallel wafers has one polar end and one opposite end adjacent to the permanent magnet and small sides located between ends in a recess for the passage of windings of the at least one coil.

8. A trip according to claim 1, wherein the moveable pallet is connected by a swivel connection to an activation component moveable in translation and acted upon by the spring.

* * * * *